US010514034B2

(12) United States Patent
Iehl et al.

(10) Patent No.: US 10,514,034 B2
(45) Date of Patent: Dec. 24, 2019

(54) IDLER GEAR FOR POSITIVE DISPLACEMENT GEAR PUMP

(71) Applicant: Viking Pump, Inc., Cedar Falls, IA (US)

(72) Inventors: Victor Christian Iehl, Waterloo, IA (US); Michael Robert Crawford, Cedar Falls, IA (US); John Howard Hall, Cedar Falls, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 165 days.

(21) Appl. No.: 15/592,458

(22) Filed: May 11, 2017

(65) Prior Publication Data

US 2018/0328360 A1 Nov. 15, 2018

(51) Int. Cl.

| | |
|---|---|
| ***F04C 15/00*** | (2006.01) |
| ***F04C 2/08*** | (2006.01) |
| ***F04C 2/14*** | (2006.01) |
| ***F04C 2/10*** | (2006.01) |
| ***F04C 18/08*** | (2006.01) |
| ***F04C 15/06*** | (2006.01) |
| ***F04C 13/00*** | (2006.01) |

(52) U.S. Cl.

CPC ..... *F04C 15/0019* (2013.01); *F04C 2/084* (2013.01); *F04C 2/101* (2013.01); *F04C 2/14* (2013.01); *F04C 13/002* (2013.01); *F04C 15/06* (2013.01); *F04C 2240/30* (2013.01)

(58) Field of Classification Search

CPC .... F04C 15/0019; F04C 15/0026; F04C 2/08; F04C 2/103; F04C 2/104; F04C 2/14; F04C 13/002; F04C 2/10; F04C 2/101; F04C 2/102; F04C 18/08

See application file for complete search history.

(56) References Cited

U.S. PATENT DOCUMENTS

2010/0111742 A1* 5/2010 Petersen ..... F04C 11/001 418/88
2012/0082579 A1* 4/2012 Mori ..... F04C 2/084 418/166

* cited by examiner

*Primary Examiner* — Deming Wan
(74) *Attorney, Agent, or Firm* — Tucker Ellis LLP; Michael G. Craig; Heather M. Barnes

(57) ABSTRACT

A gear pump for low speed transfers of viscous liquid slurries promotes growth of suspended particles, such as sugar crystals, by avoiding crushing of the particles. The pump includes a rotor gear in mesh with an eccentrically mounted idler gear supported on a boss of a pump head that includes a crescent seal extending into an opening resulting from the eccentricity of the idler gear relative to the rotor gear. The idler gear contains a radially extending land on each tooth profile, symmetrically oriented on adjacently spaced pairs of teeth. The lands, configured to minimize crushing of crystals passing through the pump, engage mating rotor teeth for sealing between inlet and outlet ports of the pump. To promote crystal growth, the lands cover only 10% to 30% of profile surface area of each tooth. To minimize gear tooth wear, the lands are axially staggered between successive adjacent pairs of teeth.

20 Claims, 3 Drawing Sheets

IDLER GEAR FOR POSITIVE DISPLACEMENT GEAR PUMP

TECHNICAL FIELD

This disclosure generally relates to positive displacement gear pumps involved in the pumping of viscous liquids. More particularly the disclosure relates to construction of an idler gear for pumping of slurries containing growing particles retained in suspension, such as sugar crystals, without crushing the particles.

BACKGROUND

Positive displacement gear pumps are commonly used to pump moderate to high viscosity liquids. A typical positive displacement gear pump includes a rotor gear mounted on a shaft; the rotor gear contains a plurality of circumferentially disposed, spaced-apart, radially inwardly directed gear teeth that also extend axially toward an open end of the pump casing. A head covers the open end of the pump casing, and the head supports an idler pin to which an idler gear is mounted eccentrically with respect to the rotor gear. The idler gear also contains a plurality of gear teeth circumferentially disposed between successive idler gear roots. In contrast to the rotor gear teeth, which extend radially inwardly, the idler gear teeth extend radially outwardly.

A crescent-shaped seal is disposed radially between unmeshed teeth of the idler gear and rotor gears, the seal being positioned within a crescent-shaped gap, generally directly opposite a point of fully engaged meshing rotor and idler gear teeth. The crescent seal is necessary to assure sufficient pressure differentials between an inlet (suction) port and an outlet (discharge) port of the pump. The idler gear teeth engage an inboard, radially inwardly curved, portion of the seal, while the rotor gear teeth engage an outboard, radially outwardly curved, portion of the seal. In addition, the intermeshing idler and rotor teeth also act as a seal between the inlet and outlet ports. Thus, sealing effects of the intermeshing teeth, as well as of the crescent seal, cooperate to retain desirable pressure differentials between the inlet and outlet ports.

Although considerable progress has been made in sealing technologies related to positive displacement gear pumps, additional improvements are needed. For example, in pumping of slurries that include growing particles, such as crystals suspended in liquid slurries, idler and rotor gear teeth often undesirably crush the suspended particles.

Thus, there is a particular need to avoid crushing of suspended particles, as for example sugar crystals within a sugar slurry during their movements through a positive displacement gear pump.

SUMMARY OF DISCLOSURE

In one form of this disclosure, a positive displacement gear pump includes a casing defining a casing interior. The casing includes inlet and outlet ports for transferring fluids though the casing interior. An external rotor gear is supported within an inboard end of the casing by a rotor shaft. A head is positioned at an outboard end of the casing, and an internal idler gear is rotationally supported on the head about an idler gear axis, the head supporting the idler gear for rotation within the casing interior. The idler gear is positioned on the head in a fixed, radially eccentric, relationship with respect to the rotor gear, having a portion of its teeth meshing with a portion of the rotor gear teeth. As disclosed, the idler gear has radially outwardly oriented teeth, while the rotor gear has radially inwardly oriented teeth.

The teeth of the idler gear also extend axially, and each meshing surface of each idler gear tooth contains a radially oriented land. Adjacently spaced pairs of the teeth define pairs of symmetrically aligned lands, each of the pair of lands spaced by a root between the spaced teeth. The lands are configured to engage meshing rotor teeth for sealing between inlet and outlet ports of the pump. The lands define boundaries of clearance relief volumes transiently formed between meshing idler gear teeth and rotor gear teeth to minimize crushing of crystals passing through the pump.

In another form of this disclosure, an idler gear is configured for use in a positive displacement gear pump having a casing that defines a casing interior, an inlet port and an outlet port in fluid communication with the casing interior. The idler gear is further configured for a positive displacement gear pump that includes a head, an open outboard end enclosed by the head, a rotor shaft, a closed inboard end through which a rotor shaft passes, the head and casing defining a pump chamber, and a rotor gear driven by the rotor shaft, the rotor gear having radially inwardly oriented teeth, the idler gear having radially outwardly oriented teeth, the rotor gear teeth meshed with the idler gear teeth, with the gears disposed within the pump chamber for rotation induced via the rotor shaft. The idler gear has teeth that contain symmetrically oriented, radially extending, lands on each side of adjacently spaced pairs of the teeth to engage and mesh with rotor gear teeth for sealing between inlet and outlet ports of the pump. The lands are configured to provide clearance relief volumes transiently formed between the meshing idler and rotor gear teeth to minimize crushing of crystals passing through the pump.

In yet another form of the disclosure, a method of making a positive displacement gear pump, having an exterior rotor gear and an internal idler gear that includes clearance relief volumes between meshing idler gear teeth and rotor gear teeth to minimize crushing of crystals passing through the pump, includes modifying an involute gear tooth profile on a standard idler gear by cutting a pair of radially oriented clearance surfaces on each tooth profile of the idler gear to form a radially oriented land on the profile, the land configured to make direct contact with teeth of the meshing rotor gear. The method further includes forming the clearance surfaces to have a depth of 20 to 40 thousandths of an inch lower than the height of each land. Under the method, each land is a raised surface, oriented radially along a radially extending profile of each tooth, and each land extends axially over a range of 10% to 30% of the total surface area of each tooth.

The features, functions, and advantages disclosed herein can be achieved independently in various other forms or embodiments, or may be combined in yet other forms or embodiments, the details of which may be better appreciated with reference to the following description and drawings.

It should be understood that the drawings are not necessarily to scale, and that disclosed embodiments are illustrated only schematically. It should be further understood that the following detailed description is merely exemplary and not intended to be limiting in application or uses. As such, although the present disclosure is, for purposes of explanatory convenience, depicted and described in only the illustrative embodiments presented, the disclosure may be implemented in numerous other embodiments, and within various other systems and environments not shown or described herein.

DETAILED DESCRIPTION

Figure 1:
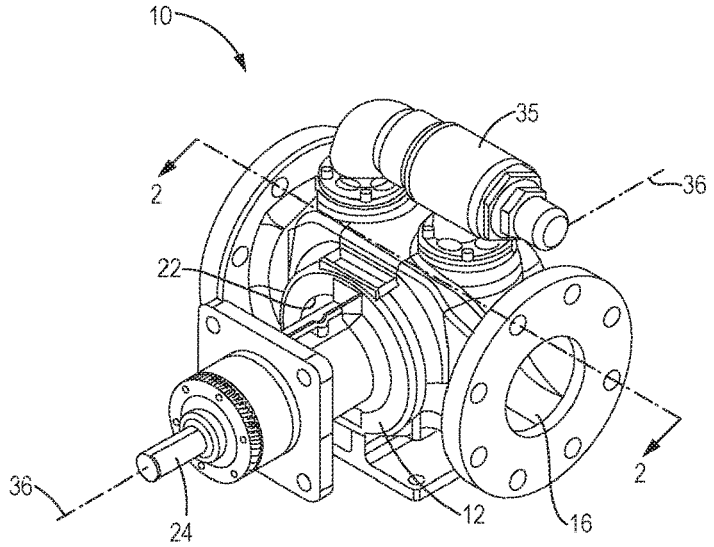
FIG. 1 is a perspective view of an embodiment of the disclosed positive displacement gear pump.
Figure 2:
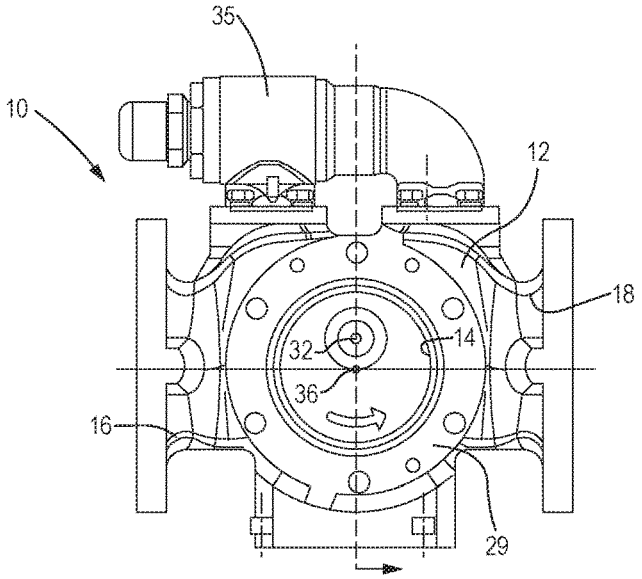
FIG. 2 is an elevation of the positive displacement gear pump embodiment of FIG. 1, as viewed along lines 2-2 of FIG. 1.
Figure 3:
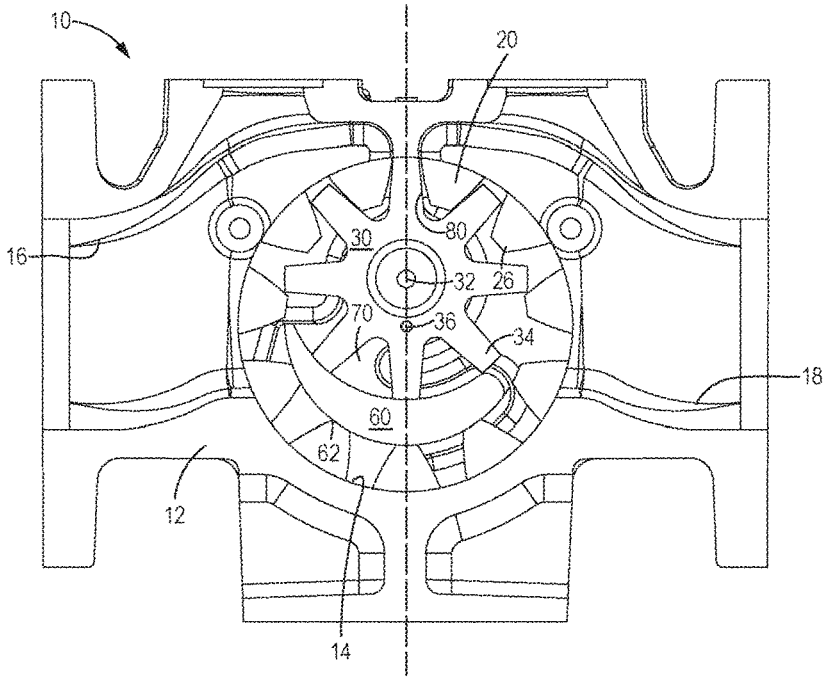
FIG. 3 is an enlarged view of a portion of FIG. 2, with the head of the pump removed to reveal rotor gear and idler gears hidden in the view of FIG. 2.

Referring initially to FIGS. 1-3, a positive displacement gear pump 10 includes a case or casing 12, having interior walls that define a casing interior 14. The pump case 12 includes a pump inlet port 16 and an outlet port 18 to accommodate transfers of liquids through the casing interior 14 of the gear pump 10. As an enlarged view of a portion of FIG. 2, FIG. 3 provides an internal view of the disclosed positive displacement gear pump 10, revealing a so-called external rotor gear 20 supported within an inboard end 22 of the casing 12 through which a rotor shaft 24 passes. The rotor shaft 24 drives the rotor gear 20 via a motor, not shown. The rotor gear 20 includes a plurality of radially inwardly oriented teeth 26 (FIG. 3).

Figure 4:
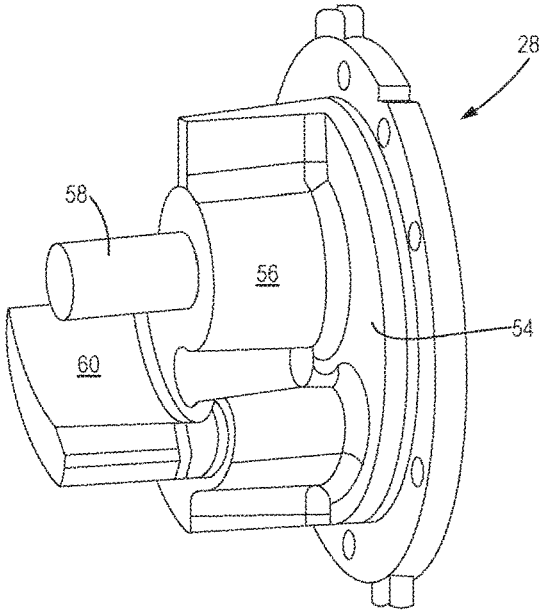
FIG. 4 is a perspective view of the head not included in FIG. 3.

Referring now also to FIG. 4, a pump head 28, adapted to be bolted to the casing 12, is configured to close an outboard, otherwise open, end 29 of the casing 12. An internal idler gear 30 (FIG. 3) is configured to be mounted for rotation on an idler pin 58 supported on a boss 56 that extends from an interior surface 54 of the head 28. The idler gear 30 is driven by the rotor gear 20 about an idler gear axis 32 (FIGS. 2 and 3). The head 28 thus supports and retains the idler gear 30 in mesh with the rotor gear 20 for rotation of the idler gear about the idler gear axis 32. For this purpose, the idler gear 30 has a plurality of radially outwardly oriented teeth 34, a portion of which mesh with a portion of the inwardly oriented teeth 26 of the rotor gear 20. The rotor gear 20 rotates about a separate rotor gear axis 36 (FIGS. 2 and 3), and is thus offset from the idler gear axis 32 to provide for rotational eccentricity between the rotor gear 20 and the idler gear 30. In the described embodiment, the casing 12 may also include a relief valve assembly 35, as shown in FIGS. 1 and 2, and as will be appreciated by those skilled in the art.

Figure 5:
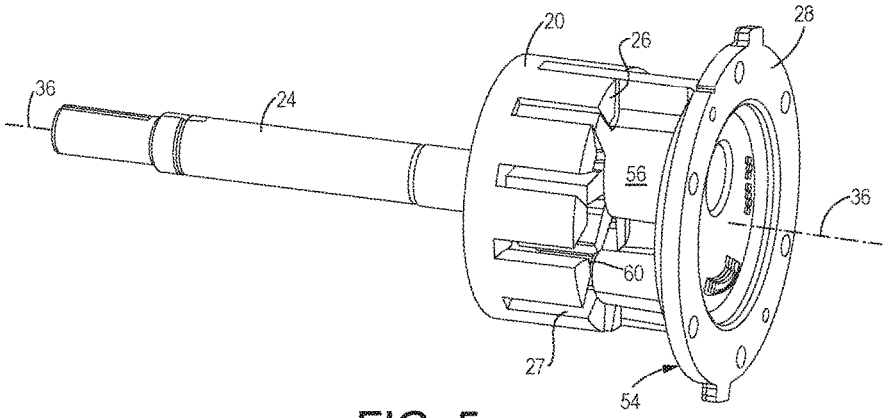
FIG. 5 is a perspective view of several pump elements, including the rotor gear shaft, the rotor gear, the idler gear, and the head.

FIG. 5 illustrates physical relationships of various elements of the pump 10 that are absent from the view of FIG. 2, including the head 28, rotor gear 20, and rotor shaft 24, the rotor shaft being directly connected to the rotor gear 20 for driving rotation thereof. The radially inwardly oriented teeth of the rotor 20 define a plurality of circumferentially spaced rotor teeth 26 that extend axially into a pump chamber 70 (FIG. 3). The pump chamber 70 is defined by the casing interior 14, essentially the interior walls of the casing 12, as well as the head 28, which encloses an outboard end 29 of the casing 12. As such, the rotor gear 20 and the idler gear 30 are eccentrically positioned with respect to one another within the pump chamber 70.

In this disclosure, the term "tooth" refers to a single gear tooth of either the rotor gear or the idler gear. In this disclosure, the term "teeth" refers to a plurality of gear teeth of either the rotor gear or the idler gear, or both in the case of meshing teeth. Moreover, the disclosed gear pump 10 need not be portrayed exclusively in the orientation shown in the drawings. For example, the inlet port 16 may have a 90° orientation with respect to the outlet port 18, instead of the 180° orientation depicted. Additional variations of elements and components may apply within the context of this disclosure.

Figure 6:
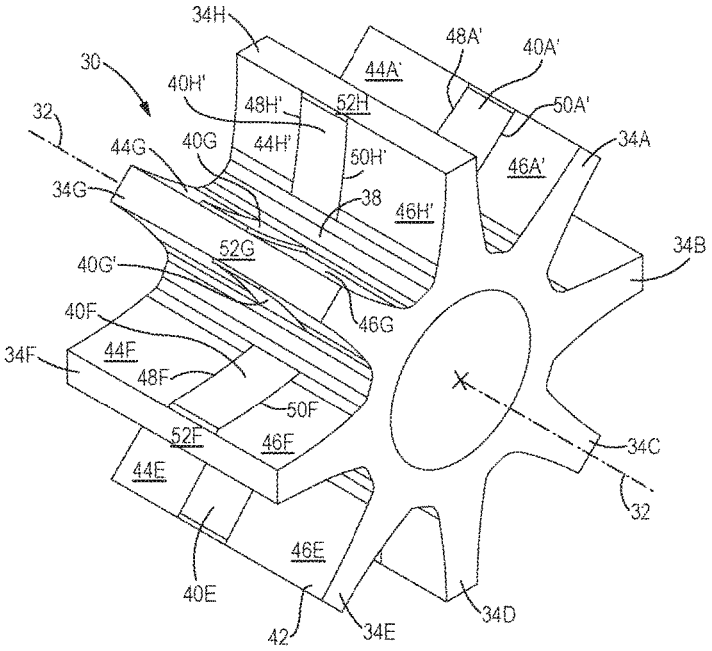
FIG. 6 is a perspective view that includes details of an embodiment of an internal idler gear constructed in accordance with this disclosure.

Referring now also to FIG. 6, the idler gear 30 includes the plurality of radially outwardly oriented idler teeth 34 disposed between alternating idler roots 38. In contrast to the depicted radially inward taper of the inwardly oriented rotor teeth 26, the idler teeth 34 taper outwardly as they extend radially away from the roots 38. Further, the circumferentially disposed rotor teeth 26 are separated by spaces 27 (FIG. 5), which receive the idler teeth 34 within the casing interior 14 of the pump 10 as shown in FIG. 3. At the top of the pump 10, the idler gear teeth 34 fully intermesh with the rotor gear teeth 26, and each meshing surface 42 of each tooth 34 has a total surface area (FIG. 6), as further referenced below.

Referring now specifically to FIG. 6, eight teeth 34, identified herein as 34A through 34H, are symmetrically and circumferentially positioned about the axis 32 of the idler gear 30. This disclosure, however, is not limited to only eight teeth, as there may be more or less teeth than as described herein, depending on size of gear pump. Each meshing surface 42 of each tooth 34A through 34H contains a corresponding raised land 40, referenced herein as 40A through 40H, in correspondence with a specific tooth. Each land, further described below, is a radially extending surface configured to intermesh with rotor gear teeth 26. Right and left axial edges 48 (A through H) and 50 (A through H) of the lands respectively define boundaries of left and right clearance surfaces 44 (A through H) and 46 (A through H), juxtaposed on each side of each land. Rather than contact with or engage intermeshing rotor gear teeth 26, the clearance surfaces 44, 46 are configured to provide clearance relief volumes 80 (FIG. 3) between the intermeshing teeth 26 of the rotor 20 and teeth 34 of the idler gear 30, to avoid crushing of particles suspended within liquids that flow through the gear pump 10, for example, sugar crystals suspended within a liquid sugar slurry.

As disclosed, each land 40 constitutes a proud or raised surface on each tooth 34 that extends 20 to 40 thousandths of an inch above the pair of clearance surfaces 44 and 46 that extend across each tooth 34. Each land 40 extends radially between a root 38 and a tip 52 (A through H) of each tooth. Adjacently spaced pairs of meshing surfaces 42 of each tooth 34, such as those of teeth 34G and 34H have axially aligned lands 40, such as the lands 40G and 40H'. Successive adjacent pairs of meshing surfaces 42, such as those of teeth 34F and 34G also have symmetrically aligned lands, such as 40F and 40G', although the latter lands 40F, 40G' may be axially staggered with respect to the lands 40G and 40H', as depicted, to minimize gear tooth wear. Since each tooth has two sides, primes are used to distinguish between the counterclockwise side of any particular tooth from its clockwise side. Thus, the land 40H' is situated on the counterclockwise side of tooth 34H, and is thereby distinguished from land 40G (a non-prime referenced element) situated on the clockwise side of tooth 34G. For reference purposes, it will be noted that the clockwise side of tooth 34H is hidden from view in FIG. 6.

With respect to minimizing gear tooth wear, it also should be pointed out that the idler gear 30 will normally have fewer teeth 34 than the rotor gear 20. As such, the two gears, turning at different speeds, will interact in a manner so that each rotor tooth 26 will contact an idler tooth land 40 in a different position upon each rotation. This operational aspect will tend to further minimize tooth wear.

To avoid crushing of particles, the lands 40, as disclosed, cover only 10% to 30% of meshing surfaces 42 of each tooth 34, with a total meshing surface defined by the area of a land 40 and the areas of its associated clearance surfaces 44, 46. In the disclosed embodiment, each meshing surface 42 comprises two clearance surfaces spaced by a single land, and each land extends over at least 90% of the radial distance between the root 38 and the tip 52 of the meshing surfaces of each tooth.

Finally, referring again to FIGS. 3 and 4, a crescent seal 60 extends from the interior surface 54 of the head 28. The crescent seal 60 is fixedly supported on the head 28 to close a crescent-shaped gap 62 that exists between transiently unmeshed idler and rotor gear teeth 34, 26 (at bottom of idler gear 30 in FIG. 3). The eccentric relationship between the idler gear and the rotor gear give rise to the gap 62, as well as the need for sealing the gap to maintain desired pressure differentials between inlet and outlet ports, as those skilled in the art will appreciate.

A method of making a positive displacement gear pump having an exterior rotor gear and an internal idler gear that includes clearance relief volumes between meshing idler gear teeth and rotor gear teeth to minimize crushing of crystals passing through the pump may include modifying an involute gear tooth profile of a standard idler gear by re-machining or cutting a pair of radially oriented clearance surfaces on each tooth profile of the idler gear to form a radially oriented land on the profile, the land configured to make direct contact with teeth of the meshing rotor gear. The method further includes forming the clearance surfaces as reliefs, having a depth of 20 to 40 thousandths of an inch lower than the height of each land. In accordance with this method, each land is formed of a raised surface along a radially extending profile of each tooth, and each land axially extends over a range of 10% to 30° % b of the total surface area of each tooth.

The method also provides that when the idler and rotor gears are meshed, the clearance surfaces cooperate with the rotor gear teeth to form transient clearance relief volumes between meshing idler and rotor gears.

While only certain embodiments have been described, alternative embodiments and various modifications will be apparent from the above description to those skilled in the art. For example, although the pump as described and shown herein is a unidirectionally rotating pump, the pump may be configured to rotate in both directions; i.e., such that the intake or suction port may become the outlet or discharge port, and vice versa. In addition, although the suspended particles within the liquids being pumped have been described as growing crystals of the type involved in sugar slurries, the described pump may also accommodate microspheres and polymers suspended in liquids. In such cases, the described idler gear structure will operate to minimize any crushing or damage to such particles as caused by shear forces associated with the pumping action. These and other alternatives may be considered equivalents, and as such may fall within the spirit and scope of the present disclosure.

INDUSTRIAL APPLICABILITY

The disclosed positive displacement gear pump 10 may enable a variety of operations with reduced risks of crushing particles, such as emerging or growing crystals within a sugar slurry being transferred by pumping action. Even more broadly, such disclosed idler gear structures may be employed in a variety of industrial and service pumps that include transfers of microspheres and polymers suspended in liquids.

The invention claimed is:

1. A method of making a positive displacement gear pump having an exterior rotor gear and an internal idler gear that includes clearance relief volumes between meshing idler gear teeth and rotor gear teeth to minimize crushing of crystals passing through the pump; the method comprising:

providing a standard idler gear having standard involute gear tooth profiles;

modifying the involute gear tooth profiles of the standard idler gear by cutting a pair of radially oriented clearance surfaces on each tooth profile of the idler gear to form a radially oriented land on the profile, the land configured to make direct contact with the respective teeth of the meshing rotor gear;

forming the clearance surfaces as reliefs having a depth of 20 to 40 thousandths of an inch lower than the a height of each land above the clearance surface; and wherein each of the land is formed of a raised surface along a radially extending profile of each of the tooth with a height from the clearance surface remaining substantially constant along the length of the land, and wherein each of the land axially extends over a range of 10% to 30% of the total surface area of each of the idler gear tooth.

2. The method of claim 1, wherein when the idler and rotor gears are meshed, the clearance surfaces of the idler gear teeth cooperate with the rotor gear teeth to form transient clearance relief volumes between the meshing idler and rotor gears.

3. A positive displacement gear pump comprising:

a casing defining a casing interior, the casing including an inlet port and an outlet ports for transferring fluids though the casing interior;

an external rotor gear supported within an inboard end of the casing by a rotor shaft, the external rotor gear having radially inwardly oriented teeth;

a head positioned at an outboard end of the casing;

an internal idler gear rotationally supported on the head, the internal idler gear having an idler gear axis, the head supporting the internal idler gear for rotation about the idler gear axis within the casing interior, the internal idler gear having radially outwardly oriented teeth, and being positioned on the head in a fixed, radially eccentric, relationship with the external rotor gear and having a portion of its teeth meshing with a portion of the external rotor gear teeth;

wherein the teeth of the internal idler gear also extend axially, and each meshing surface of each of the idler gear tooth comprises a radially oriented land, and wherein adjacently spaced pairs of the meshing surfaces define pairs of axially aligned lands, each spaced by a root, the lands being configured to engage meshing rotor teeth for sealing between an inlet port and an outlet ports of the pump; and wherein the lands define boundaries of clearance relief volumes transiently formed between the meshing idler gear teeth and rotor gear teeth to minimize crushing of crystals passing through the pump; and wherein height of the respective lands from the surface of the idler gear tooth remain substantially constant along length of the land.

4. The positive displacement gear pump of claim 3, wherein the lands are limited to 10% to 30% of a total meshing surface area of each of the idler gear tooth.

5. The positive displacement gear pump of claim 3, wherein the lands are axially staggered between successive adjacent pairs of the idler gear teeth.

6. The positive displacement gear pump of claim 3, wherein each of the land defines a clearance surface on each of the idler gear tooth, each of the clearance surface is disposed at radially extending sides of each of the land, each of the clearance surface is configured to remain free of contact with the rotor gear teeth, and wherein each of the land is raised 20 to 40 thousandths of an inch above the clearance surface of each of the idler gear tooth.

7. The positive displacement gear pump of claim 6, wherein a total surface area of each of the idler gear tooth of the internal idler gear is defined by the area of the land of the idler gear tooth plus the area of the clearance surfaces of the idler gear tooth.

8. The positive displacement gear pump of claim 7, wherein each of the land extends axially over a range of 10% to 30% of total surface area of each of the idler gear tooth, and each of the idler gear tooth comprises two clearance surfaces spaced by the land.

9. The positive displacement gear pump of claim 3, wherein each of the respective idler gear teeth has an outer radial extremity defining a tip, and has a root situated radially inwardly of the tip, the respective roots being shared with an adjacent tooth, and wherein each of the land extends over at least 90% of the radial distance between the root and the tip of each of the tooth.

10. The positive displacement gear pump of claim 9, wherein the boundaries of the clearance relief volumes are respectively defined by the interior walls of the pump chamber, the root of the idler gear, and the land between the meshing idler gear and rotor gear teeth.

11. The positive displacement gear pump of claim 3, wherein the head includes an inner surface containing a boss configured to retain the idler gear in mesh with the rotor gear.

12. The positive displacement gear pump of claim 11, wherein the inner surface further comprises a crescent seal configured to seal a crescent-shaped gap between unmeshed teeth of the idler and rotor gears.

13. The positive displacement gear pump of claim 11, wherein the casing interior and the inner surface of the head comprise a pump chamber, the pump chamber having interior walls in proximity with the external rotor gear.

14. An idler gear for use in a positive displacement gear pump having a casing that defines a casing interior, an inlet port and an outlet port in fluid communication with the casing interior, a head, an open outboard end enclosed by the head, a rotor shaft, a closed inboard end through which a rotor shaft passes, the head and casing defining a pump chamber, and a rotor gear driven by the rotor shaft, the rotor gear having radially inwardly oriented teeth, the idler gear having radially outwardly oriented teeth, the rotor gear teeth meshed with the idler gear teeth, the gears disposed within the pump chamber for rotation induced via the rotor shaft; wherein the idler gear comprises:

the idler gear teeth that comprise axially aligned, radially extending, lands on each side of adjacently spaced pairs of the teeth to engage the meshing rotor gear teeth for sealing between the inlet port and the outlet ports of the pump;

wherein the lands are configured to provide clearance relief volumes transiently formed between the meshing idler gear and rotor gear teeth to minimize crushing of crystals passing through the pump; and wherein height of the respective lands from the surface of the idler tooth remain substantially constant along length of the land.

15. The idler gear of claim 14, wherein the lands are limited to 10% to 30% of a total meshing surface area of respective teeth of the idler gear.

16. The idler gear of claim 14, wherein the lands are axially staggered between the successive adjacent pairs of idler teeth.

17. The idler gear of claim 14, wherein the clearance relief volumes of each of the respective idler teeth are delineated by each of the respective lands, each of the respective lands defining a clearance surface on each respective tooth teeth disposed on either side of the land, the clearance surface configured to remain free of contact with the respective meshed rotor gear tooth, and wherein each of the respective lands are raised 20 to 40 thousandths of an inch above the clearance surface of each of the respective teeth.

18. The idler gear of claim 14, wherein the head includes an inner surface containing a boss configured to retain the idler gear in mesh with the rotor gear.

19. The idler gear of claim 18, wherein the inner surface further comprises a crescent seal configured to seal a crescent-shaped gap between unmeshed teeth of the idler and rotor gears.

20. The idler gear of claim 18, wherein the casing interior and the inner surface of the head comprise a pump chamber, the pump chamber having interior walls in proximity with the external rotor gear.

* * * * *